United States Patent [19]

Delves

[11] 4,053,287

[45] Oct. 11, 1977

[54] BRAKE SHOE GRINDING JIG

[75] Inventor: Elsworth Richard Delves, Lower Hackworth Village, England

[73] Assignee: Purpose Engineers Limited

[21] Appl. No.: 665,384

[22] Filed: Mar. 10, 1976

[51] Int. Cl.[2] ..... B24B 5/36

[52] U.S. Cl. ..... 51/105 R; 51/96; 51/237 R

[58] Field of Search ..... 51/237, 234, 96, 105 R, 51/103 WH, 124 R, 108; 157/13

[56] References Cited

U.S. PATENT DOCUMENTS

| | | | |
|---|---|---|---|
| 1,952,130 | 3/1934 | Harrison | 51/237 R |
| 2,032,864 | 3/1936 | Begg | 51/105 R |
| 2,052,981 | 9/1936 | Kuhle | 51/124 R |
| 2,208,879 | 7/1940 | Blazek | 51/237 R |
| 2,225,806 | 12/1940 | Stone | 51/96 |
| 2,674,309 | 4/1954 | Bigelow | 51/105 R |
| 2,901,869 | 9/1959 | Billeter | 51/96 |
| 2,973,791 | 3/1961 | French | 157/13 X |
| 3,387,411 | 6/1968 | Atzberger | 51/95 R |

FOREIGN PATENT DOCUMENTS

| | | | |
|---|---|---|---|
| 175,333 | 3/1961 | Sweden | 51/105 R |

*Primary Examiner*—Harold D. Whitehead
*Attorney, Agent, or Firm*—Michael J. Striker

[57] ABSTRACT

A jig for use in grinding brake shoe linings of brake shoes having pivot means at one end which engage respective spaced pivot pins in the brake drum, the jig comprising a turntable, having central swivel means, mounting means on the turntable, means for radially adjusting the mounting means relative to the swivel means, a pair of pivot pins in fixed spaced relationship and provided on the mounting means, each said pin engaging, in use, with the pivot means of one of the brake shoe linings to be ground, angle setting means on the turntable and diametrically opposite said mounting means, said angle setting means defining a variable dimensions abutment whereby the ends of the brake shoes opposite to said mounting means abut opposite sides of the abutment, whereby, the brake shoe linings can be positioned substantially on the circumference they occupy in a brake drum by adjustment of the mounting means and setting of the angle setting means.

10 Claims, 7 Drawing Figures

BRAKE SHOE GRINDING JIG

This invention is concerned with a brake shoe grinding jig.

When relining the brake shoes of commercial vehicles, the linings are sometimes ground to suit the brake drum diameter. This provides a much more efficient braking effect than if grinding is not carried out and a long "bedding-in" period is avoided. In practice, however, it is difficult to grind the linings accurately to the desired diameter and an object of the present invention is to provide a brake shoe grinding jig which facilitates accurate grinding.

The invention is particularly concerned with grinding of linings on "cam block brake shoes," i.e. for the type of brake arrangement where two shoes are each pivoted at adjacent ends, the opposite ends being spring-urged towards each other; a cam is located between these said opposite ends so that rotation of the cam urges the brake shoe linings into engagement with the brake drum.

It is a further object of the invention to provide a jig which can be used for accurate grinding of cam block brake shoes and other types of shoes. The present invention provides in a broad sense a jig for use in grinding brake shoe linings of brake shoes having pivot means at one end, the jig comprising a turntable, radially adjustable mounting means on the turntable and adapted for engagement with said pivot means of a pair of brake shoes to mount the shoes pivotally on the turntable for relative angular movement, preferably, in a horizontal plane, angle setting means on the turntable and diametrically opposite said mounting means, said angle setting means defining an abutment whereby the ends of the brake shoes opposite to said mounting means abut opposite sides of the abutment so as to position the brake shoes substantially on the circumference they occupy in a brake drum.

The invention more particularly provides a jig for use in grinding brake shoe linings of brake shoes having pivot means at one end, which engage respective spaced pivot pins in the brake drum, the jig comprising a turntable having central swivel means, mounting means on the turntable, means for radially adjusting the mounting means relative to said swivel means, a pair of pivot pins in fixed spaced relationship and provided on the mounting means, each said pin engaging, in use, with the pivot means of one of the brake shoe linings to be ground, a support element on the turntable and diametrically opposite said mounting means, a plurality of angle setting members of different dimensions and each corresponding to a particular brake drum assembly, said members being individually mountable on said support element whereby the ends of the brake shoes opposite to said mounting means abut opposite sides of the angle setting member mounted on said support element, a plurality of distance setting members of different dimensions and each corresponding to a particular brake drum assembly, means on the turntable for individually mounting a selected one of said distance setting members, said radial adjusting means being adjustable to abut said mounting means against the distance setting member mounted on the turntable, for pre-setting the radial position of said mounting means.

Reference is now made to the accompanying drawings, wherein.

Figure 1:
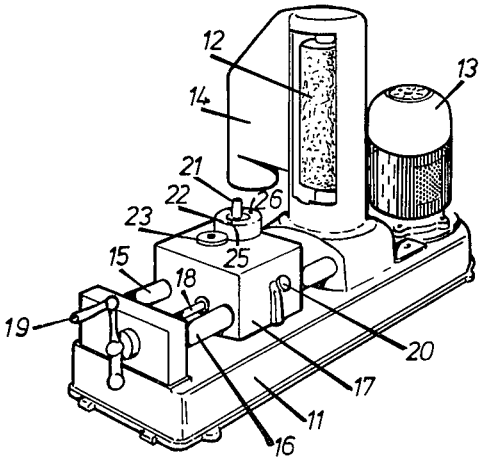
FIG. 1 is a perspective view of a grinding machine for grinding brake shoe linings and adapted for mounting a jig according to the invention.

Referring to FIG. 1, the grinding machine shown comprises a base 11 mounting a grinding cylinder 12, which is horizontally rotatable about its longitudinal axis. A motor 13 is provided for driving the grinding wheel and take-off duct 14 is provided for removing dust. A pair of parallel, horizontal guide rods 15, 16 are provided mounting a carriage 17 which is movable towards and away from the grinding wheel by means of a screw 18, rotatable by a handle 19. A locking screw 20 is provided for holding the carriage in a pre-set position.

The carriage carries an upright spindle 21 about which is rotatably mounted a wheel 22. The wheel 22 has friction engagement with a wheel 23, which is angularly unidirectional.

Figure 2:
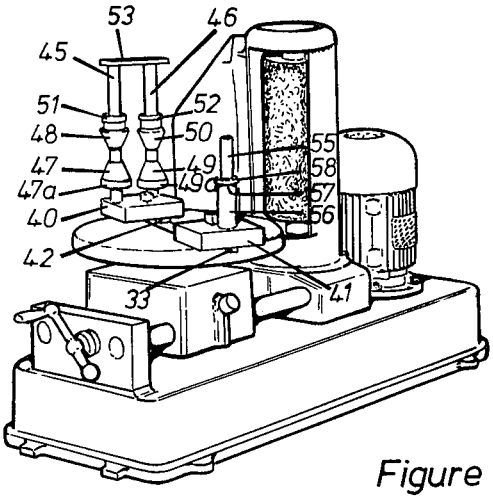
FIG. 2 is a perspective view of the machine of FIG. 1 and including the jig according to the invention.
Figure 4:
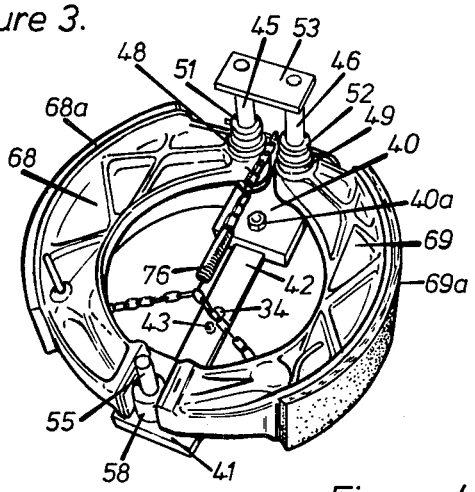
FIG. 4 is a perspective top view of the jig with a pair of cam block brake shoes mounted thereon ready for grinding.

Referring now additionally to FIGS. 2 and 4, there is shown a jig 30 having a turntable 31, which is mountable on the wheel 22 about the spindle 21. The wheel 22 has apertures 25, 26 which receive complementary pegs (not shown) on the turntable so as to lock the wheel 22 to the turntable. The turntable, therefore, is rotatable in only one angular direction, due to the inhibiting effect of the wheel 23 in the opposite direction.

Figure 3:
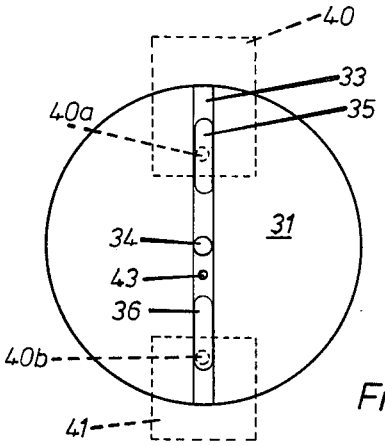
FIG. 3 is a plan view of a turntable of the jig of FIG. 2.

The turntable, as shown in FIG. 3, is provided with a diametrically extending guide groove 33, centrally of which is an aperture 34 for receiving the spindle 21. At each side of the aperture 34 in the bottom of the groove is an elongated slot 35, 36.

Referring to FIGS. 2 and 4, it will be seen that first and second blocks 40, 41 have sliding engagement with the grooves 33, one at each end. The blocks can be locked in desired positions by bolts, **40*a*, 41*a*, respectively which extend through the corresponding slots 35, 36 and engage with nuts (not shown) beneath the turntable 31. The desired relative location of the blocks is determined by a flat setting bar 42, which engages with the spindle 21 and a pin 43 on the turntable. The blocks are moved into abutment with respective ends of the setting bar 42**.

The first block 40 carries a pair of fixed vertical upstanding screw-threaded anchor pins 45, 46. Mounted on each pin is a nut **47*a*, 49*a*, a pair of conical locating washers 47, 48 and 49, 50 and a locking nut 51, 52. A strengthening plate 53** bridges the two pins.

The second block 41 carries a vertical, upstanding pin 55 having a widened bottom portion 56 defining a shoulder 57. A setting disc 58 seats on the shoulder 57.

Figure 5:
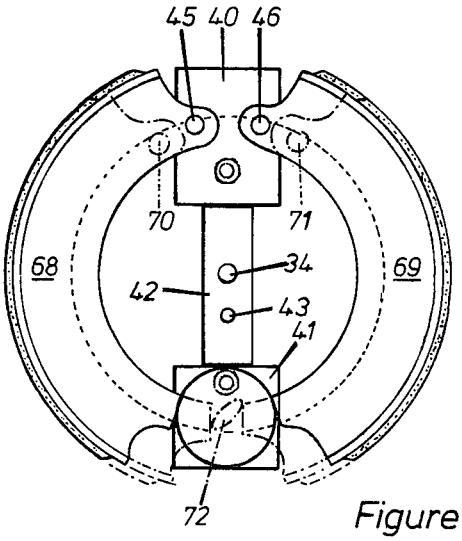
FIG. 5 is a diagrammatic plan view of the jig showing the brake shoes of FIG. 4 and also showing, in dash lines, the relative positions of the brake shoes in the brake assembly.

The jig 30 described is intended for use with cam block brake shoes 68, 69 of the type mounted on corresponding spaced pins such as illustrated in dash lines in FIG. 5 at 70 and 71. A cam 72 is also shown for operating the brakes. The anchor pins 45, 46 of the jig 30 are closer together than the pins 70, 71 and are at a fixed distance, whereas brake assemblines are of varying sizes and the distance between the pins 70, 71 is variable. In order to locate the brake shoes in the relative positions which they should occupy in the brake assembly, the setting disc 58 is provided to compensate for the closeness of the anchor pins 45, 46. In practice a set of such discs is provided, each disc corresponding to a particular make of brake assembly. In addition to the correct angular positioning of the brake shoes, it is also necessary to gauge the distance between the anchor pins 45, 46 and the setting disc pin 55 correctly, to reproduce the relative positions in the brake assembly. For this purpose, a set of the setting bars 42 is provided, each bar corresponding to a particular make of brake assembly.

In order to grind the linings **68*a*, 69*a* of a particular pair of brake shoes 68, 69 the jig is firstly set up according to the make of brake assembly. This is simply done by locating the blocks 40, 41 by means of the appropriate setting bar 42 and by locating the appropriate setting disc 58 on the spindle 55. The brake shoes 68, 69 are pivoted on corresponding anchor pins 45, 46 seating on the lower conical washers 47, 49 which are adjusted in height by the nuts 47*a*, 49*a* to level the shoes. The upper conical washers 48, 49 and the nuts 51, 52 are then located on top of the brake shoes and the strengthening plate 53 is repositioned. The brake shoes are urged into engagement with the setting disc 58 by a chain and spring arrangement 76. The nuts 51, 52** are then tightened and washers are located beneath the setting disc, if necessary, to locate the disc centrally with respect to the brake shoes.

The carriage 17 is positioned, so that the grinding wheel 12 engages one of the shoes. The turntable is then turned so that the shoe linings **68*a*, 69*a*** are ground to the correct radius. It will be appreciated that this procedure is very simple and can be rapidly carried out by an unskilled person. It is only necessary to set up the jig with the correct setting disc and setting bar. These can be marked according to the make of brake assembly with which they are to be used.

The anchor block 40 may be adapted to mount a central single anchor pin for pivotally mounting both shoes. This would be used for grinding shoes of brake assemblies of the type having only a single anchor pin.

Figure 7:
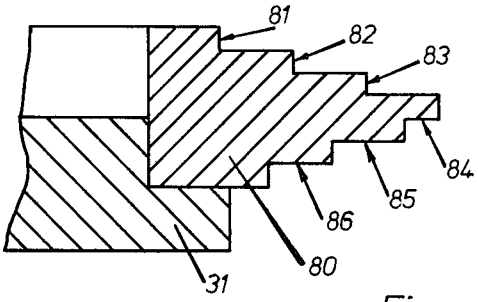
FIG. 7 is a sectional view of the line 7—7 of FIG. 6.
Figure 6:
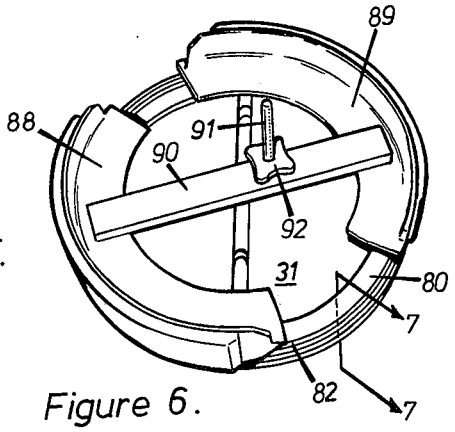
FIG. 6 is a perspective top view of the turntable with modified jig parts mounted thereon and showing a pair of floating brake shoes arranged for grinding.

The jig may also be used for grinding shoes which are both floating in their brake assembly. For this purpose a ring 80 is mounted on the turntable 31, as shown in FIG. 6. This ring has a series of steps 81 to 86 radially spaced from the periphery, as shown in FIG. 7. The steps are formed on both opposite sides of the ring and the ring can be inverted for using the underlying steps 84 to 86.

In use, the shoes 88, 89 to be ground are mounted, as shown in FIG. 6 on one of the steps 82. The shoes are held in place by a clamping bar 90, screw 91 and nut 92.

When any new brake assembly is produced, it is, of course, a simple matter to provide an appropriate setting disc and setting bar, so that the jig can be used with that assembly.

What I claim is:

1. A jig for use in grinding brake shoe linings of brake shoes having pivot means at one end which engage respective spaced pivot pins in the brake drum, the jig comprising a turntable, having central swivel means, mounting means on the turntable, means for radially adjusting the mounting means relative to the swivel means, a pair of pivot pins in fixed spaced relationship and provided on the mounting means, each said pin engaging, in use, with the pivot means of one of the brake shoe linings to be ground, angle setting means on the turntable and diametrically opposite said mounting means, said angle setting means defining a variable dimension abutment whereby the ends of the brake shoes opposite to said mounting means abut opposite sides of the abutment, whereby the brake shoe linings can be positioned substantially on the circumference they occupy in a brake drum by adjustment of the mounting means and setting of the angle setting means.

2. A jig according to claim 1, wherein the angle setting means comprises a plurality of abutments, each corresponding to a particular brake drum assembly and being selectively mountable on the turntable.

3. A jig according to claim 2, including a pin mounted on the turntable, each of said angle setting means being a circular member engageable on the pin.

4. A jig according to claim 1, including means for radially adjusting said angle setting means.

5. A jig according to claim 4, including a plurality of distance setting members and means on the turntable for selectively and individually mounting said distance setting members for gauging the adjusted positions of said mounting means, said angle setting means and said turntable, each distance setting member corresponding to a particular brake drum assembly.

6. A jig for use in grinding brake shoe linings of brake shoes having pivot means at one end, which engage respectively spaced pivot pins in the brake drum, a turntable having central swivel means, mounting means on the turntable, means for radially adjusting the mounting means relative to said swivel means, a pair of pivot pins in fixed spaced relationship and provided on the mounting means, each said pin engaging, in use, with the pivot means of one of the brake shoe linings to be ground, a support element on the turntable and diametrically opposite said mounting means, a plurality of angle setting members of different dimensions and each corresponding to a particular brake drum assembly, said members being individually mountable on said support element whereby the ends of the brake shoes opposite to said mounting means abut the opposite sides of the angle setting member mounted on said support element, a plurality of distance setting members of different dimensions and each corresponding to a particular brake drum assembly, means on the turntable for individually mounting a selected one of said distance setting members, said radial adjusting means being adjustable to abut said mounting means against the distance setting member mounted on the turntable, for pre-setting the radial position of said mounting means.

7. A jig according to claim 6, wherein said support element is radially adjustably mounted on the turntable to abut against said distance setting member for pre-setting the radial position of said support element.

8. A jig according to claim 7, wherein said mounting means and said support element are defined by a pair of blocks, one block mounting said pivot pins and the other block mounting said angle setting means, said turntable defining a diametral guide groove, and said blocks being adapted for sliding movement on the turntable along said guide groove.

9. Apparatus for grinding brake shoe linings each having pivot means at one end, said apparatus comprising a body, rotary grinding means on the body, drive means for rotating the grinding means, guide means on the body, a carriage reciprocable along the guide means towards and away from the grinding means, a turntable rotatably mounted on the carriage, mounting means on the turntable, a pair of pivots on the mounting means for engagement with respective means of a pair of brake shoes to mount the shoes pivotally on the turntable for relative angular movement, the mounting means being radially adjustable on the turntable, angle setting means on the turntable and diametrically opposite said mounting means, said angle setting means defining an abutment of variable width whereby the ends of the brake shoes opposite to said mounting means abut opposite sides of the abutment.

10. Apparatus according to claim 9, wherein said angle setting means comprises a plurality of angle setting members of different dimensions and each corresponding to a particular brake drum assembly, said members being individually mountable on the turntable whereby the ends of the brake shoes opposite to said mounting means abut opposite sides of the angle setting members mounted on said support element, a plurality of distance setting members on different dimensions and each corresponding to a particular brake drum assembly, means on the turntable for individually mounting a selected one of said distance setting members, the mounting means being radially adjustable to abut the distance setting member mounted on the turntable for pre-setting the radial position of said mounting means.

* * * * *